US012631385B2

(12) United States Patent
Wilbourn et al.

(10) Patent No.: US 12,631,385 B2
(45) Date of Patent: May 19, 2026

(54) IMMOBILIZER TRAY FOR MODULAR SHIPPING CONTAINER

(71) Applicant: Cryoport, Inc., Brentwood, TN (US)

(72) Inventors: James Wilbourn, Costa Mesa, CA (US); Bobby Onel, Laguna Beach, CA (US); Hugh Vu, Santa Ana, CA (US)

(73) Assignee: Cryoport, Inc., Brentwood, TN (US)

( * ) Notice: Subject to any disclaimer, the term of this patent is extended or adjusted under 35 U.S.C. 154(b) by 371 days.

(21) Appl. No.: 18/135,683

(22) Filed: Apr. 17, 2023

(65) Prior Publication Data

US 2024/0344751 A1 Oct. 17, 2024

(51) Int. Cl.

| | |
|---|---|
| ***F25D 3/06*** | (2006.01) |
| ***B65D 25/06*** | (2006.01) |
| ***B65D 81/18*** | (2006.01) |
| *F25D 23/08* | (2006.01) |

(52) U.S. Cl.

CPC ..... *F25D 3/06* (2013.01); *B65D 25/06* (2013.01); *B65D 81/18* (2013.01); *F25D 23/08* (2013.01)

(58) Field of Classification Search

CPC ..... F25D 3/06; B65D 25/06

See application file for complete search history.

(56) References Cited

U.S. PATENT DOCUMENTS

| | | | | |
|---|---|---|---|---|
| 5,642,923 | A * | 7/1997 | Meacham | B65D 19/44 312/258 |
| 10,743,696 | B2 * | 8/2020 | Yang | A47G 29/124 |
| 2015/0001168 | A1 | 1/2015 | Busby et al. | |
| 2016/0244209 | A1 | 8/2016 | Hain | |
| 2019/0316290 | A1 * | 10/2019 | Denha | D06F 95/002 |
| 2020/0115140 | A1 | 4/2020 | Kuhn et al. | |
| 2021/0371164 | A1 * | 12/2021 | Mattila | B65D 43/163 |
| 2022/0082317 | A1 | 3/2022 | Bollinger et al. | |
| 2022/0219858 | A1 * | 7/2022 | Carlson | B65D 25/02 |
| 2022/0369571 | A1 * | 11/2022 | Pointek | B65D 25/08 |
| 2024/0076117 | A1 | 3/2024 | Wallin | |

FOREIGN PATENT DOCUMENTS

| | | |
|---|---|---|
| CN | 204236906 | 4/2015 |
| CN | 207107211 U | 3/2018 |
| CN | 110844347 | 2/2020 |
| CN | 110254903 B | 8/2020 |
| CN | 213139488 U | 5/2021 |

(Continued)

OTHER PUBLICATIONS

KIPO; International Search Report dated Aug. 8, 2024 in PCT Application Serial No. PCT/US2024/024486.

(Continued)

*Primary Examiner* — Lionel Nouketcha

(74) *Attorney, Agent, or Firm* — Snell & Wilmer L.L.P.

(57) ABSTRACT

An adaptable immobilizer tray for use in a shipping container (e.g., a cryogenic shipping container) that can be configured to transition from a first configuration to a second configuration. The first configuration is configured to receive a payload of a first size, and the second configuration is configured to receive a payload of a second size, wherein the first size and the second size are different. The adaptable immobilizer tray can be adaptable to two or more payload sizes and configured to secure the payloads during transport of the shipping container.

21 Claims, 7 Drawing Sheets

(56) References Cited

FOREIGN PATENT DOCUMENTS

| | | |
|---|---|---|
| CN | 214453488 U | 10/2021 |
| JP | H06-127573 | 5/1994 |
| JP | 2004-042995 | 2/2004 |
| KR | 20-0443141 | 1/2009 |
| WO | 2018005859 | 1/2018 |
| WO | 2020157488 | 8/2020 |
| WO | 2022060844 | 3/2022 |

OTHER PUBLICATIONS

USPTO, Requirement for Restriction Apr. 6, 2023 with U.S. Appl. No. 17/476,036.

PCT; International Search Report and Written Opinion issued by KIPO dated Dec. 21, 2021 in PCT Application Serial No. PCT/US2021/050470.

PCT; International Preliminary Report on Patentability issued by KIPO dated Mar. 21, 2023 in PCT Application Serial No. PCT/US2021/050470.

PCT; International Preliminary Report on Patentability (IPRP) dated Oct. 30, 2025 in PCT Application No. PCT/US2024/024486.

* cited by examiner

IMMOBILIZER TRAY FOR MODULAR SHIPPING CONTAINER

FIELD

The present disclosure generally relates to a dry ice shipping assembly, and more particularly to an adaptable immobilizer tray for use in a dry ice shipping assembly.

BACKGROUND

In the health, medical, pharmaceutical and/or life science industries, the safe storage of a payload in a temperature-controlled and watertight environment is an important aspect of the industry. Typically, when a payload is shipped, the shipper packs the payload into an enclosure, which is non-reusable, such as a carboard box, and may pack shipping material, such as a polystyrene foam container and/or dry ice, around the payload to maintain the temperature. The shipper may place or scoop dry ice pellets or blocks into an inner packaging made of an insulating material, such as the polystyrene foam, and around the payload to maintain the temperature of the payload. The shipper may place the inner packaging within an outer enclosure, such as a sturdy cardboard box, and partially seal the outer enclosure. Due to this configuration, the use of dry ice limits the shipper to transporting the payload in a single temperature range. Moreover, the shipper can be opened and refilled with dry ice throughout the transport and delivery in order to maintain the temperature if dry ice finishes evaporating.

SUMMARY

Disclosed herein is an adaptable immobilizer tray for use in a shipping container (e.g., a cryogenic shipping container). In various embodiments, the adaptable immobilizer tray is configured to transition from a first configuration to a second configuration. The first configuration is configured to receive a payload of a first size, and the second configuration is configured to receive a payload of a second size, wherein the first size and the second size are different. The adaptable immobilizer tray disclosed herein can be adaptable to two or more payload sizes and configured to secure the payloads during transport of the shipping container, in accordance with various embodiments.

An adaptable immobilizer tray is disclosed herein. In various embodiments, the adaptable immobilizer tray can comprise: a base plate; a first sidewall extending vertically from a first side of the base plate; a second sidewall extending vertically from a second side of the base plate; and a moveable plate configured to transition from a first position adjacent to the base plate to a second position vertically spaced apart from the base plate.

In various embodiments, the first sidewall and the second sidewall each comprise a first slot spaced apart longitudinally from a second slot, the moveable plate is slidingly engaged with the first slot and the second slot, the first slot of the first sidewall is disposed laterally opposite the first slot of the second sidewall, and the second slot of the first sidewall is disposed laterally opposite the second slot of the second sidewall.

In various embodiments, the first slot and the second slot each comprise: a vertical portion extending from a bottom end to a top end, and a longitudinal portion extending from the top end to a longitudinal end spaced apart longitudinally from the top end. The first slot and the second slot can each further comprise a notch disposed in the longitudinal end of the longitudinal portion.

In various embodiments, the adaptable immobilizer tray can further comprise a first configuration corresponding to the moveable plate being in the first position and a second configuration corresponding to the moveable plate being in the second position, the first configuration configured to receive a first payload, the second configuration configured to receive a second payload, the first payload having a larger volume than the second payload. The first payload can have a first volume that is up to two times greater than a second volume of the second payload.

In various embodiments, the first sidewall and the second sidewall each comprise a plurality of apertures disposed therethrough.

In various embodiments, the moveable plate is slidingly coupled to the first sidewall and the second sidewall.

A shipping container is disclosed herein. In various embodiments, the shipping container can comprise: an enclosure; and an adaptable immobilizer tray configured to be disposed within a cavity of the enclosure, the adaptable immobilizer tray being reconfigurable between a first configuration and a second configuration, the first configuration configured to secure a first payload, the second configuration configured to secure a second payload, the first payload being a different volume relative to the second payload.

In various embodiments, the enclosure includes a lid and a base, the lid configured to transition between a closed position and an open position to provide access to the cavity.

In various embodiments, the adaptable immobilizer tray includes a moveable plate configured to transition a height of a payload area from a first height to a second height, and the second height is less than the first height. In various embodiments, the first height is up to two times greater than the second height.

In various embodiments, the adaptable immobilizer tray includes a first sidewall, a second sidewall, and a moveable plate, and the moveable plate is moveably coupled to the first sidewall and the second sidewall.

In various embodiments, the first sidewall and the second sidewall each comprise a first slot, the moveable plate comprises a first guide and a second guide, the first guide is configured to engage the first slot of the first sidewall, and the second guide is configured to engage the first slot of the second sidewall. In various embodiments, the first slot of the first sidewall is disposed laterally opposite the first slot of the second sidewall. In various embodiments, the first sidewall and the second sidewall each comprise a second slot disposed aft of the first slot, the moveable plate further comprises a third guide and a fourth guide, the third guide is configured to engage the second slot of the first sidewall, and the fourth guide is configured to engage the second slot of the second sidewall.

A method of using a shipping container is disclosed herein. In various embodiments, the method comprises: transitioning an adaptable immobilizer tray from a first configuration to a second configuration, the first configuration configured to receive a first payload; disposing a second payload in the adaptable immobilizer tray, the second payload having a smaller volume relative to the first payload; placing the adaptable immobilizer tray and the second payload in a cavity of the shipping container; disposing a dry ice container on the adaptable immobilizer tray, the dry ice container including dry ice disposed therein, the second payload restrained vertically between the dry ice container and the adaptable immobilizer tray; and closing the shipping container.

In various embodiments, the transitioning the adaptable immobilizer tray from the first configuration to the second configuration further comprises translating a moveable plate of the adaptable immobilizer tray from a first position to a second position, and the second payload is restrained vertically between the dry ice container and the moveable plate in response to the disposing the dry ice container on the adaptable immobilizer tray.

In various embodiments, the transitioning the moveable plate from the first position to the second position further comprises sliding the moveable plate vertically relative to a first sidewall and a second sidewall of the adaptable immobilizer tray and placing the moveable plate in the second position.

In various embodiments, the moveable plate defines a first height for a payload area relative to a top edge of the adaptable immobilizer tray, the moveable plate defines a second height for the payload area relative to the top edge of the adaptable immobilizer tray, and the first height is greater than the second height.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the following detailed description and claims in connection with the following drawings. While the drawings illustrate various embodiments employing the principles described herein, the drawings do not limit the scope of the claims.

DETAILED DESCRIPTION

The following detailed description of various embodiments herein refers to the accompanying drawings, which show various embodiments by way of illustration. While these various embodiments are described in sufficient detail to enable those skilled in the art to practice the disclosure, it should be understood that other embodiments may be realized and that changes may be made without departing from the scope of the disclosure. Thus, the detailed description herein is presented for purposes of illustration only and not of limitation. Furthermore, any reference to singular includes plural embodiments, and any reference to more than one component or step may include a singular embodiment or step. Also, any reference to attached, fixed, connected, or the like may include permanent, removable, temporary, partial, full or any other possible attachment option. Additionally, any reference to without contact (or similar phrases) may also include reduced contact or minimal contact. It should also be understood that unless specifically stated otherwise, references to "a," "an" or "the" may include one or more than one and that reference to an item in the singular may also include the item in the plural. Further, all ranges may include upper and lower values and all ranges and ratio limits disclosed herein may be combined.

Disclosed herein are systems, devices and/or methods for an adaptable immobilizer tray that restrains a payload during shipment of a shipping container (e.g., a hardened reusable modular shipping container). The shipping container can be configured to maintain a temperature within the payload area within a temperature range. The adaptable immobilizer tray can be adaptable to different payload sizes or configurations. For example, the adaptable immobilizer tray is configured to be oriented in a first configuration configured to receive a first payload and configured to be oriented in a second configuration to receive a second payload that is different in size and/or volume from the first payload. Since the adaptable immobilizer tray is reconfigurable between at least two configurations, the shipping systems and devices disclosed herein can be reconfigured based on a respective payload being shipped. Stated another way, the adaptable immobilizer tray facilitates shipments of different size payloads with the same system where only minor adjustments are made to the immobilizer tray to accommodate a different sized payload, in accordance with various embodiments.

Figure 1:
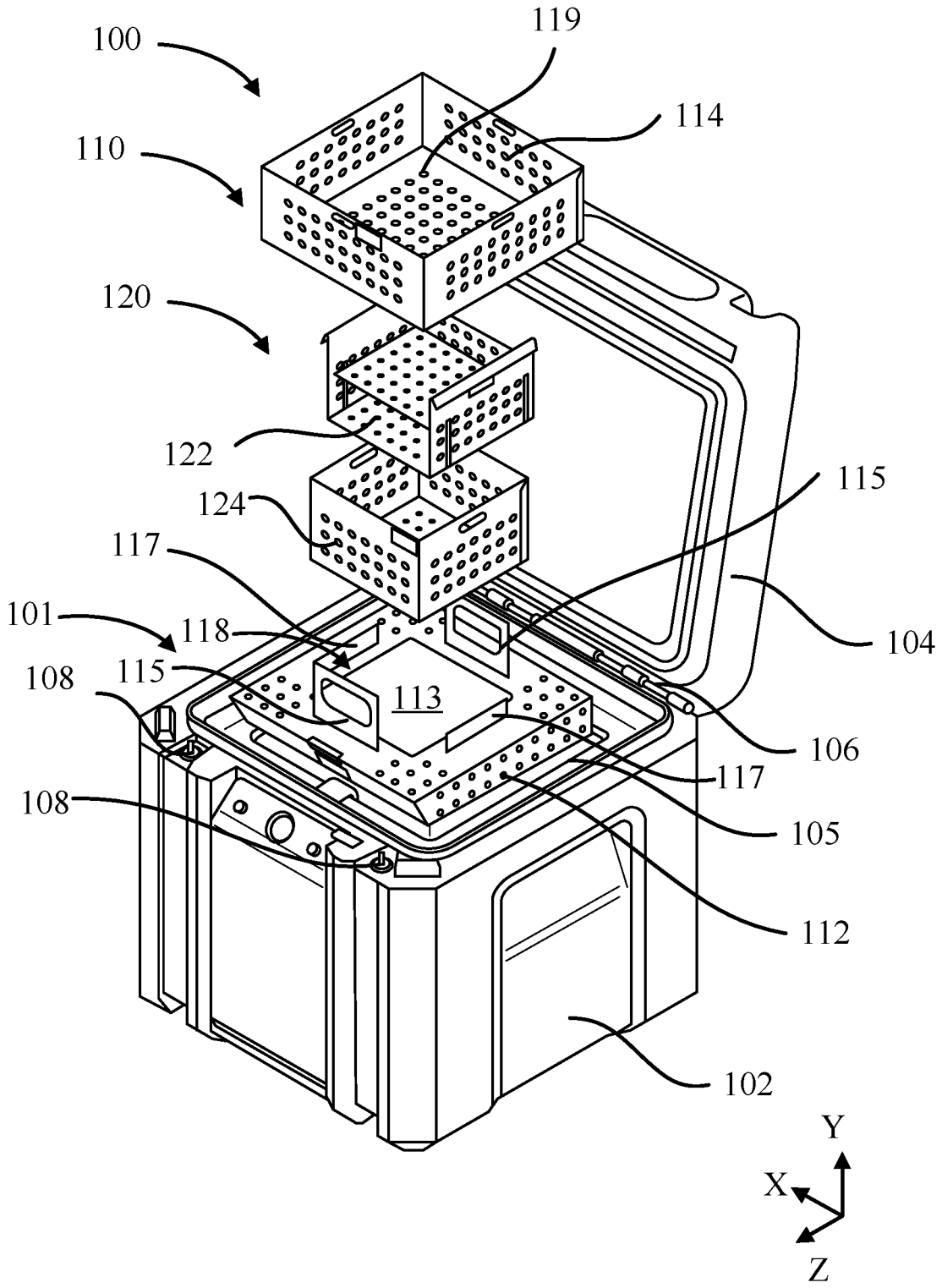
FIG. 1 illustrates an exploded view of a shipping container, in accordance with various embodiments.

Referring now to FIG. 1, a perspective exploded view of a shipping container 100 is illustrated, in accordance with various embodiments. The shipping container 100 is configured to maintain a temperature-controlled environment for a payload, such as biological materials or the like, disposed within a payload area, as described further herein. In various embodiments, the shipping container 100 is further configured to immobilize the payload during shipping. "Immobilize" as referred to herein includes securing, restraining, or otherwise limiting movement of a payload. Stated another way, "immobilizing" as referred to herein can include limiting movement of the payload in a lateral direction (X-direction), a longitudinal direction (Y-direction), and a vertical direction (Z-direction). In various embodiments, "immobilize" can refer to limiting a movement in a respective direction (i.e., a X-direction, a Y-direction, and/or a Z-direction) to less than 2 inches (5.1 cm), or less than 1 inch (2.54 cm), or less than 0.5 inches (1.27 cm), or less than 0.25 inches (0.635 cm) of movement in the respective direction.

In various embodiments, the shipping container 100 is configured to immobilize the payload during transportation of the shipping container 100 to protect the payload. For example, the payload can include fragile containers therein (e.g., glass vials, glass test tubes, etc.). Accordingly, protection and immobilization of the payload during transport may be desirable.

In various embodiments, the shipping container 100 includes a housing 101. The housing 101 includes a base 102 and a lid 104. The housing 101 can be made from a hardened or rigid material, such as polyethylene, polycarbonate, or other polymer, which may be cleaned and decontaminated and then reused. The hardened or rigid material protects the shipping container 100 during transport and may be made of a material that is designed to absorb shocks and vibrations that occur during transport. The shipping container 100 may have a material or coating exposed on the exterior of the shipping container 100 that allows for adhesives (e.g., labels, logos, signs) to bond thereto.

In various embodiments, the housing 101 may be shaped as a cube or other three-dimensional polygonal shape with multiple faces. In this regard, the housing 101 can be configured to be stackable with a housing of an adjacent shipping container, which can also be in accordance with the shipping container 100, during transport. Stated another way, the shipping container 100 can be stacked on top of another shipping container 100 during transport of multiple shipping containers, in accordance with various embodiments.

The lid 104 can be positioned on top of the base 102 and configured to transition between an open position and a closed position. On a rear side of the base 102, the shipping container 100 can have an attachment device 106 (or a plurality of attachment devices), which couples a rear end of the lid 104 to the base 102. The attachment device 106 can couple (e.g., pivotably couple, slidingly couple, or the like) the lid 104 to the base 102 and allow the lid 104 to transition from the closed position to the open position and vice versa. For example, the lid 104 can be configured to transition from the closed position to the open position to allow a user access to the payload area of the base 102, and the lid 104 can be configured to transition from the open position to the closed position to seal a payload therein during shipment.

In various embodiments, the attachment device 106 can comprise a swing, a pivot, a hinge, a track and guide, or the like. The present disclosure is not limited in this regard. In various embodiments, the attachment device 106 can comprise molded-in hinges. In various embodiments, the attachment device 106 can be bolted, screwed, riveted, or the like to the base 102 and/or the lid 104 to allow replacement of the lid 104, the base 102, or the attachment devices 106.

On a forward face of the shipping container 100, the shipping container 100 may have fastening device 108 (or a plurality of the fastening device 108), such as a clip, buckle, latch, or other connector configured for fastening. The fastening device 108 may have one portion or end that is positioned on the lid 104 (or base 102) which clips, couples to, latches, buckles, snaps-on or otherwise fastens, connects or otherwise couples to a second portion or end that is positioned on the base 102 (or lid 104). When the lid 104 is positioned in the closed position and the two portions or ends of the fastening device 108 are coupled, fastened or otherwise connected, the shipping container 100 forms a sealed enclosure that may be at least partially sealed against infiltration by external fluids and/or release of fluids from inside the sealed enclosure. In various embodiments, the shipping container 100 is water resistant.

The shipping container 100 further comprises an internal cavity 105 defined by the base 102 of the housing 101. In various embodiments, the internal cavity 105 may, for example, be approximately 12 inches (about 30.5 cm)×12 inches (about 30.5 cm)×12 inches (about 30.5 cm). In various embodiments, the intern cavity 105 may be approximately 15 inches (about 38.1 cm)×15 inches (about 38.1 cm)×15 inches (about 38.1 cm). However, the present disclosure is not limited in this regard. For example, the internal cavity 105 can be larger or smaller or differently shaped as desired. The present disclosure is not limited in this regard. While the internal cavity 105 as described above is described with cubic shape in one non-limiting example, other shapes are contemplated. The internal cavity 105 may receive and/or store a temperature control system 110 that is configured to maintain a temperature within the internal cavity 105 of the shipping container 100 and/or the payload when the payload is inserted or positioned within the internal cavity 105 as described further herein.

The shipping container 100 further comprises the temperature control system 110 and an immobilization assembly 120. The temperature control system 110 is configured to provide temperature control (e.g., in a passive or active manner) to a payload stored in the housing 101 during transportation of the shipping container 100. In this regard, the temperature control system 110 is configured to keep the payload within a predetermined temperature range during transport of the shipping container 100. The immobilization assembly 120 is configured to immobilize the payload during transportation of the shipping container 100. In various embodiments, a component of the temperature control system 110 can also perform a function associated with the immobilization assembly 120, and vice versa. In this regard, certain components disclosed herein can have dual functionality, as described further herein, in accordance with various embodiments.

In various embodiments, an immobilizer tray 122, an outer enclosure 124, a dry ice container 112, and a dry ice container 114 form the immobilization assembly 120. Stated another way, the immobilizer tray 122, the outer enclosure 124, the dry ice container 112, and the dry ice container 114, in combination, are configured to immobilize a payload (e.g., payload 201 or payload 301 from FIGS. 2A-B and 3A-B as described further herein) during transit to facilitate safe and secure transit of the payload, in accordance with various embodiments. The immobilizer tray 122 is configured to receive a payload (e.g., payload 201 or payload 301 from FIGS. 2A-B and 3A-B) and immobilize the payload in a lateral direction (i.e., the X-direction). In various embodiments, the outer enclosure 124 is configured to receive the immobilizer tray 122 therein. The payload can be disposed in the immobilizer tray 122 prior to placing the immobilizer tray 122 in the outer enclosure 124. However, the present disclosure is not limited in this regard. For example, the immobilizer tray 122 can be configured and placed in the outer enclosure 124 prior to disposing a payload therein, and still be within the scope of this disclosure. After the immobilizer tray 122 is disposed in the outer enclosure 124, the payload is further immobilized in a longitudinal direction (i.e., the Y-direction).

In various embodiments, as described further herein, the immobilizer tray 122 is an adaptable immobilizer tray. In this regard, the immobilizer tray 122 is configured to transition between various configurations to accommodate different size payloads in a quick and efficient manner. Stated another way, the immobilizer tray 122 is adaptable, or reconfigurable, to immobilize payloads that differ in size. Accordingly, based on a size of a payload that is being shipped, the immobilizer tray 122 can vary a receptacle size of the immobilizer tray 122 and maintain an immobilization functionality during shipment of the payload, in accordance with various embodiments, as described further herein.

The outer enclosure 124 and the immobilizer tray 122 can be configured to secure the payload in a longitudinal direction (i.e., a Z-direction), and the immobilizer tray 122 and the dry ice container 114 can be configured to secure the payload in a vertical direction (i.e., a Y-direction). In this regard, after a payload is disposed in the immobilizer tray 122 and the immobilizer tray 122 is disposed in the outer enclosure 124, the outer enclosure 124 (with the immobilizer tray 122 and the payload disposed therein) can be placed in a receptacle 118 defined by the dry ice container 112 (e.g., defined by barriers 117 and handles 115), and the dry ice container 114 can be placed on top of the immobilizer tray 122 to immobilize the payload in the X-direction, Y-direction, and Z-direction. Stated another way, the immobilization assembly 120 can be configured to immobilize a payload in six degrees of freedom during transport of the shipping container 100, in accordance with various embodiments.

In various embodiments, the temperature control system 110 can comprise dry ice containers 112, 114 that are configured to house dry ice during transport of the shipping container 100. For example, the cavity 113 of the dry ice container 112 can be configured to receive dry ice therein and receptacle 119 of dry ice container 114 can be configured to receive dry ice therein. In various embodiments, dry ice can also be disposed around a perimeter of the outer enclosure 124 (e.g., vertically between the dry ice container 112 and the dry ice container 114). However, the present disclosure is not limited in this regard. For example, the dry ice containers 112, 114 can be configured to surround (or nearly surround) the payload during transportation of the payload and still be within the scope of this disclosure.

In various embodiments, the temperature control system 110 can be configured to provide a consistent temperature-controlled environment within the internal cavity 105 of the shipping container 100 during transport of the shipping container 100. In various embodiments, the dry ice container 112 can be shaped and configured to be disposed within the internal cavity 105 of the base 102 of the shipping container 100. The dry ice container 112 can be a base dry ice container that has an outer profile (or shape) that matches (or nearly matches) a shape of the internal cavity 105. In various embodiments, a positive shape matching a negative shape, as described herein refers to an outer profile of a positive shape that is within 2 inches (5.1 cm), or within 1 inch (2.54 cm), or within 0.5 inches (1.27 cm), or within 0.25 inches (0.635 cm) of an inner profile of a negative shape, in accordance with various embodiments. The present disclosure is not limited in this regard. In various embodiments, by having an inner profile of the internal cavity 105 match (or nearly match) an outer profile of the dry ice container 112, the dry ice container 112 can be secured in the shipping container 100 laterally, longitudinally, and/or vertically during transport, in accordance with various embodiments. Although described herein as positive shapes matching (or nearly matching) negative shapes, the present disclosure is not limited in this regard. For example, additional components, (i.e., conforming type components) can be utilized between "matching components" as described herein to facilitate tight and secure fits and still be within the scope of this disclosure.

In various embodiments, the dry ice container 112 can include handles 115 and barriers 117. In this regard, the barriers 117 can be spaced apart in a lateral direction (i.e., the X-direction) and the handles 115 can be spaced apart in the longitudinal direction (i.e., the Z-direction), and the barriers 117 and the handles 115 can define the receptacle 118 therein. The receptacle 118 can be sized and configured to receive the outer enclosure 124. Stated another way, the barriers 117 can immobilize the outer enclosure 124 in the lateral direction, and the handles 115 can immobilize the outer enclosure 124 in the longitudinal direction.

In various embodiments, the dry ice container 112, the outer enclosure 124 and the immobilizer tray 122 can be removed from the internal cavity 105 together (i.e., after the dry ice container 114 is removed from the internal cavity 105). In various embodiments, the dry ice container 112 can be loaded first (e.g., via the handles 115, followed by the outer enclosure 124 with the immobilizer tray 122 and a payload (e.g., payload 201 or payload 301 from FIGS. 2A-B and 3A-B and described further herein) disposed therein, then followed by the dry ice container 114. However, the present disclosure is not limited in this regard. For example, the dry ice container 112, the outer enclosure 124 with the immobilizer tray 122 and a payload (e.g., payload 201 or payload 301 from FIGS. 2A-B and 3A-B and described further herein) disposed therein can be loaded in the internal cavity 105 together, and still be within the scope of this disclosure. Accordingly, the immobilization assembly 120 can be assembled with a payload therein without the dry ice container 114 disposed thereon, the dry ice containers 112, 114 can be loaded with dry ice, and the dry ice container 112, the outer enclosure 124, the immobilizer tray 122, and the payload can be loaded into the internal cavity 105 of the base 102, and the dry ice container 114 can be disposed thereon prior to shipping the shipping container 100, in accordance with various embodiments.

In various embodiments, dry ice can be disposed in the cavity 113 prior to disposing the outer enclosure 124 therein. However, the present disclosure is not limited in this regard. In various embodiments, dry ice can be disposed within the internal cavity 105 prior to disposing the dry ice container 112 therein (i.e., to surround a bottom plate of the outer enclosure 124 with dry ice), or the like. Any configuration of dry ice surrounding the outer enclosure 124 is within the scope of this disclosure.

In various embodiments, by having dry ice surrounding the payload entirely (or nearly entirely) during transport of the payload, the temperature control system 110 can keep the payload within a desired temperature range, in accordance with various embodiments.

Figure 2B:
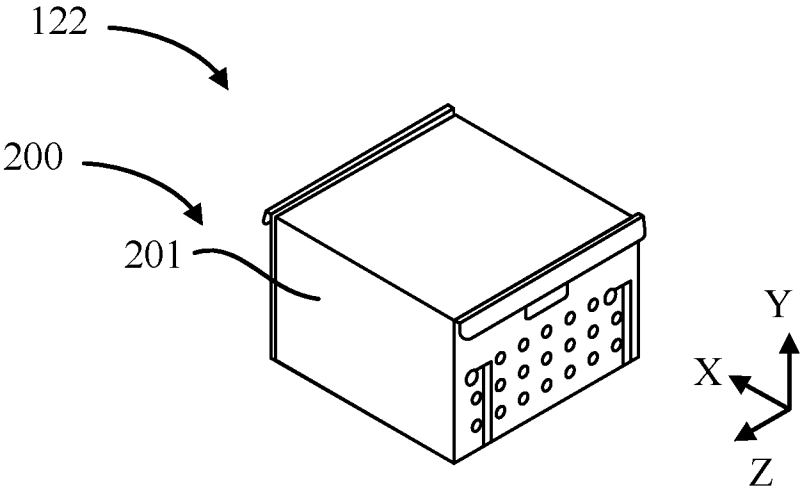
FIG. 2B illustrates a perspective view of an immobilizer tray after assembly, in accordance with various embodiments.
Figure 2A:
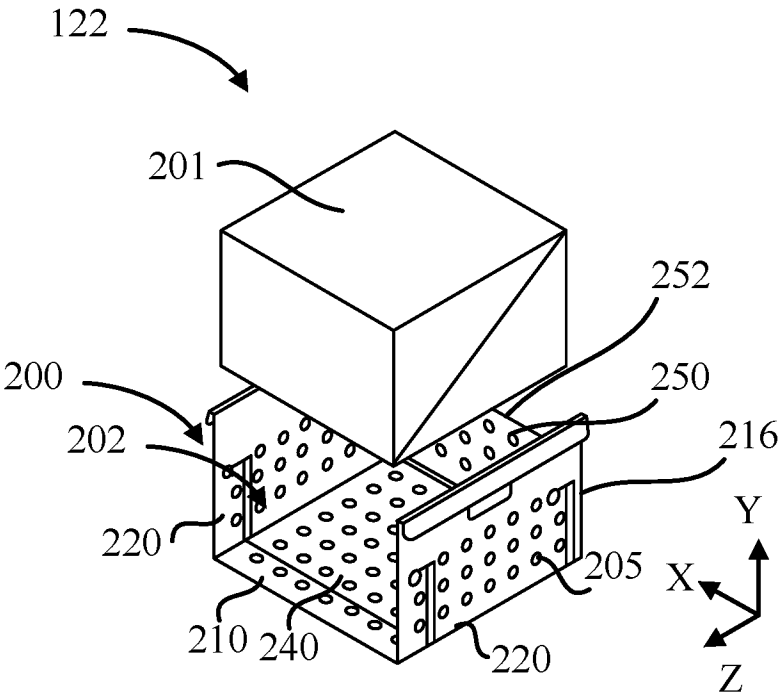
FIG. 2A illustrates a perspective view of an immobilizer tray in a first configuration during assembly prior to shipping a payload, in accordance with various embodiments.

Referring now to FIGS. 2A and 2B, a perspective view of the immobilizer tray 122 in a first configuration 200 during assembly (FIG. 2A) and after assembly (FIG. 2B) (i.e., during loading of a payload 201), is illustrated, in accordance with various embodiments. Similarly, with reference to FIGS. 3A and 3B, a perspective view of the immobilizer tray 122 in a second configuration 300 during assembly (FIG. 3A) and after assembly (FIG. 3B) (i.e., during loading of a payload 301), is illustrated, in accordance with various embodiments.

In the first configuration 200 from FIGS. 2A and 2B, the immobilizer tray 122 is configured to receive a payload 201 having a first size. In various embodiments, the payload 201 can include a cuboid shape (i.e., having a substantially constant length, width, and height). However, the present disclosure is not limited in this regard. For example, various other shapes, such as a cylindrical shape, a square shape, a pentagonal prism, a hexagonal prisms, etc., are within the scope of this disclosure. In the second configuration 300 from FIGS. 3A and 3B, the immobilizer tray 122 is configured to receive a payload 301 having a second size. The size of the payload 301 is different from the size of the payload 201. For example, in various embodiments, the payload 201 can have a volume that is between 1.5 and 3 times greater than a volume of the payload 301. In various embodiments, the payload 201 can have a volume that is up to two times greater than a volume of the payload 301.

With combined reference now to FIGS. 2A, 2B, 3A, and 3B, in various embodiments, the payload 201 can have a same width and a same length relative to the payload 301. In this regard, the payload 201 and the payload 301 may only differ with respect to a height (e.g., a height of payload 201 can be approximately double a height of payload 301). In this regard, the immobilizer tray 122 can be configured to only vary a height dimension for the immobilization assembly 120 as described further herein. By only varying a height dimension of the immobilizer tray 122, a mechanism for changing configurations between the first configuration 200 from FIGS. 2A and 2B to the second configuration 300 from FIGS. 3A and 3B relative to an immobilizer tray capable of varying multiple dimensions. However, the present disclosure is not limited in this regard. For example, an immobilizer tray configured to vary a width dimension (i.e., a lateral dimension) or a length dimension (i.e., a longitudinal dimension) is also within the scope of this disclosure. Although the immobilizer tray 122 is described herein as only being adaptable in one dimension (e.g., a height dimension), the present disclosure is not limited in this regard. For example, the immobilizer tray 122 can be configured to vary in a height dimension, a width dimension, a length dimension, and/or any combination of a height dimension, a width dimension and a length dimension and be within the scope of this disclosure.

In various embodiments, the payload 201 has a volume that is approximately double the payload 301. However, the present disclosure is not limited in this regard. For example, any adaptable immobilizer tray that is capable of transitioning between two or more configurations to vary a receptacle size is within the scope of this disclosure.

Figure 3B:
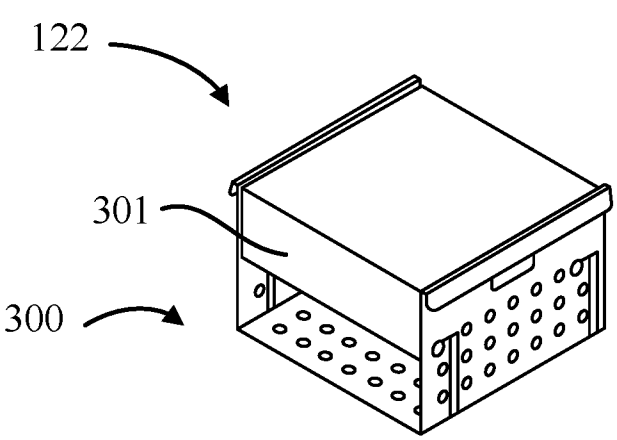
FIG. 3B illustrates a perspective view of an immobilizer tray after assembly, in accordance with various embodiments.
Figure 3A:
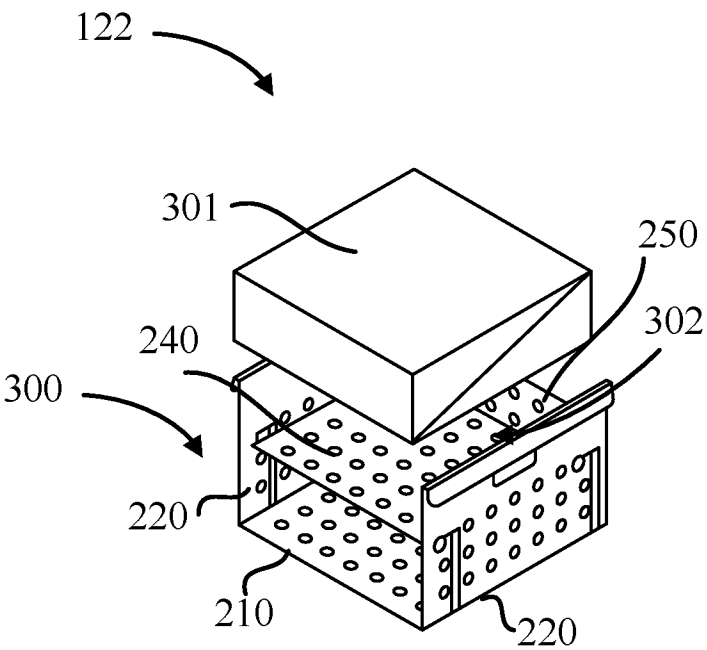
FIG. 3A illustrates a perspective view of an immobilizer tray in a second configuration during assembly prior to shipping a payload, in accordance with various embodiments.

In various embodiments, the immobilizer tray 122 comprises a base plate 210, a first sidewall 220, a second sidewall 230, and a moveable plate 240. In various embodiments, the immobilizer tray 122 can further comprise a third sidewall 250 (e.g., a back sidewall) disposed at an aft side 216 of the base plate 210 and extending vertically from the base plate 210 to a top end 252. Although illustrated as including the third sidewall 250, the present disclosure is not limited in this regard. For example, with brief reference back to FIG. 1, the outer enclosure 124 can restrain a payload (e.g., payload 201 from FIGS. 2A and 2B or payload 301 from FIGS. 3A and 3B) in the longitudinal direction (i.e., the Z-direction), without the third sidewall 250 and still be within the scope of this disclosure. In the first configuration 200 and the second configuration 300, the moveable plate 240 and the sidewalls 220, 230 define a receptacle (e.g., receptacle 202 as shown in FIG. 2A and receptacle 302 as shown in FIG. 3A). In various embodiments, the receptacle 202 from FIG. 2A, and the receptacle 302 from FIG. 3A are further defined by the third sidewall 250. In various embodiments, the receptacle (e.g., receptacle 202 from FIG. 2A and the receptacle 302 from FIG. 3A) is configured to receive a payload (e.g., payload 201 or payload 301) therein during assembly of the immobilization assembly 120 from FIG. 1. In this regard, the immobilizer tray 122 can be reconfigurable between the first configuration 200 from FIG. 2A and the second configuration 300 from FIG. 3A depending on a size of a payload to be shipped, and the immobilizer tray 122 can be assembled with the same components of the immobilization assembly 120 in a quick and efficient manner without any other changes, in accordance with various embodiments.

In various embodiments, each wall (or plate) of the immobilizer tray 122 includes a plurality of apertures (e.g., apertures 205) disposed therethrough. Similarly, each component of the immobilization assembly 120 and the temperature control system 110 from FIG. 1 can include a plurality of apertures disposed therethrough to facilitate fluid communication between the dry ice (i.e., the dry ice disposed in the dry ice containers 112, 114 and around a perimeter of the outer enclosure 124) and the payload that is secured, restrained, and/or immobilized by the immobilization assembly 120. Stated another way, the plurality of apertures can facilitate fluid communication with dry ice to maintain a consistent temperature for the payload (e.g., payload 201 from FIGS. 2A, 2B or payload 301 from FIGS. 3A, 3B) being transported by the shipping container 100 from FIG. 1.

In various embodiments, in response to receiving the payload (e.g., payload 201 or payload 301, the sidewalls 220, 230 defined by the receptacle (e.g., receptacle 202 or receptacle 302) immobilizes the payload (e.g., payload 201 or payload 301) in a lateral direction (i.e., an X-direction). In various embodiments, longitudinal direction (i.e., the Z-direction) and the vertical direction (i.e., the Y-direction) of the payload (e.g., payload 201 or payload 301) are not restrained until the immobilization assembly 120 from FIG. 1 is assembled.

Figure 4B:
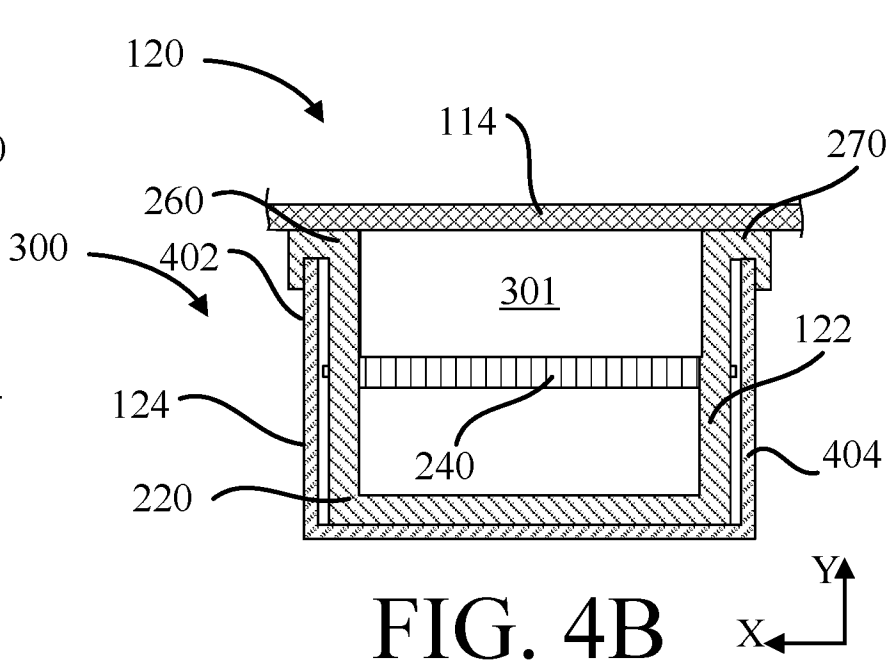
FIG. 4B illustrates a cross-sectional view of an immobilization assembly with an immobilizer tray in a second configuration after assembly prior to shipping a payload, in accordance with various embodiments
Figure 4A:
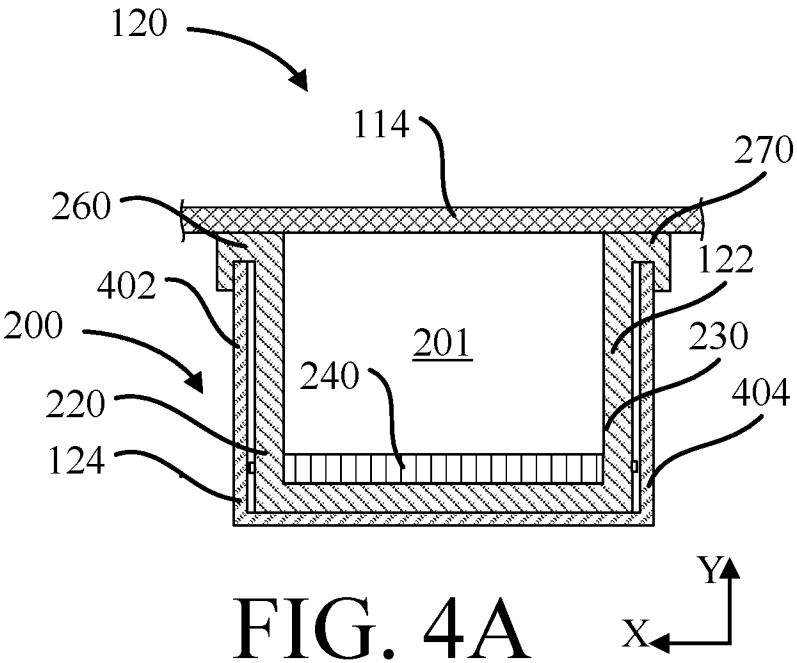
FIG. 4A illustrates a cross-sectional view of an immobilization assembly with an immobilizer tray in a first configuration after assembly prior to shipping a payload, in accordance with various embodiments.

For example, with reference now to FIGS. 4A and 4B, a cross-sectional front view (in the X-Y plane) of the immobilization assembly 120 in an assembled state with the immobilizer tray 122 in the first configuration 200 (FIG. 4A) and with the immobilizer tray 122 in the second configuration 300 (FIG. 4B) is illustrated, in accordance with various embodiments. In various embodiments, the moveable plate 240 and the dry ice container 114 of the immobilization assembly 120 restrain the payload (e.g., payload 201 or payload 301) in the vertical direction (i.e., the Z-direction). Similarly, the third sidewall 250 from FIGS. 2A and 3A and the outer enclosure 124 of the immobilization assembly 120 immobilize the payload (e.g., payload 201 or payload 301) in the longitudinal direction (i.e., the Y-direction).

In various embodiments, the outer enclosure 124 can be coupled to the immobilizer tray 122 as shown in FIGS. 4A and 4B. For example, immobilizer tray 122 can further comprise a first flange 260 extending outward (i.e., away from a center of the immobilizer tray 122 in the lateral direction (i.e., the X-direction) from the first sidewall 220. Similarly, the immobilizer tray 122 can further comprise a second flange 270 extending outward (i.e., away from the center of the immobilizer tray 122 in an opposite lateral direction from the first flange 260) from the second sidewall 230. In this regard, the flanges 260, 270 can each define a recess therein that is configured to receive a sidewall (e.g., sidewall 402 for first flange 260 and sidewall 404 for second flange 270) of the outer enclosure 124. In various embodiments, each flange is configured to couple the outer enclosure 124 to the immobilizer tray 122 (e.g., via a press fit or the like). Although illustrated as being coupled in a press fit manner, the present disclosure is not limited in this regard. For example, the outer enclosure 124 can be coupled to the immobilizer tray 122 via fasteners or the like and still be within this disclosure. Alternatively, in various embodiments, the immobilizer tray 122 may not have flanges 260 and 270, and the immobilizer tray 122 can be loosely placed in the outer enclosure 124. However, in such a configuration, the tolerances for the outer enclosure 124 and the immobilizer tray 122 would have to be tighter, which could increase manufacturing costs of each component, in accordance with various embodiments.

Figure 5C:
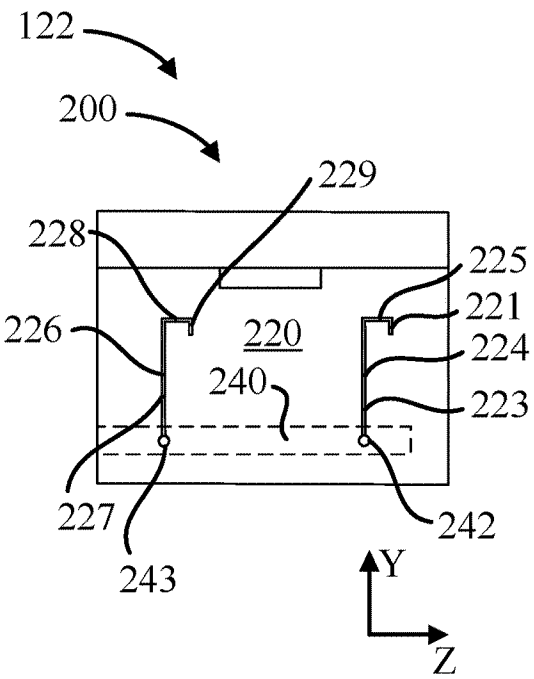
FIG. 5C illustrates a side view of an immobilizer tray, in accordance with various embodiments.
Figure 5B:
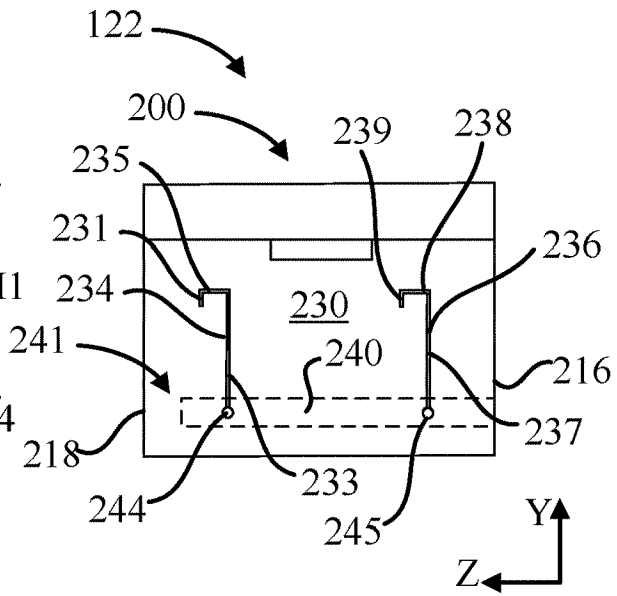
FIG. 5B illustrates a side view of an immobilizer tray, in accordance with various embodiments.
Figure 5A:
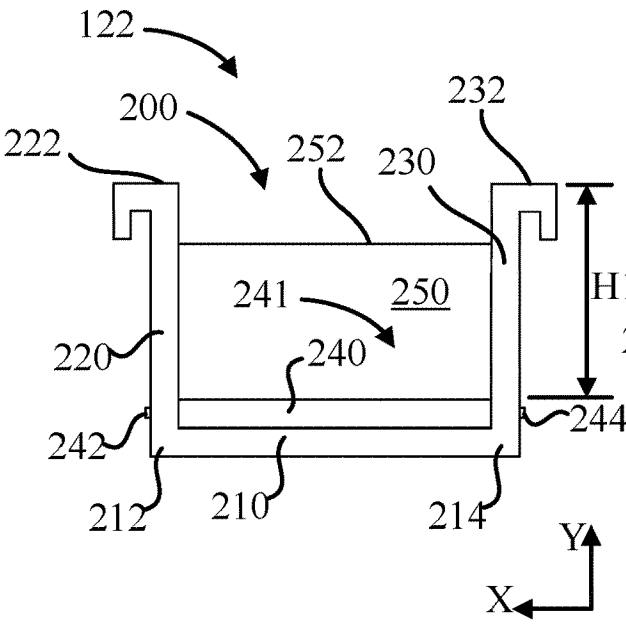
FIG. 5A illustrates a front view of an immobilizer tray, in accordance with various embodiments.

Referring now to FIGS. 5A, 5B, 5C a front view (FIG. 5A) and side views (FIGS. 5B, 5C) of the immobilizer tray 122 in the first configuration 200 is illustrated, in accordance with various embodiments. Similarly, with brief reference to FIGS. 6A and 6B, a front view (FIG. 6A) and a side view (FIG. 6B) of the immobilizer tray 122 in the second configuration 300 is illustrated, with like numerals depicting like elements, in accordance with various embodiments.

Figure 6B:
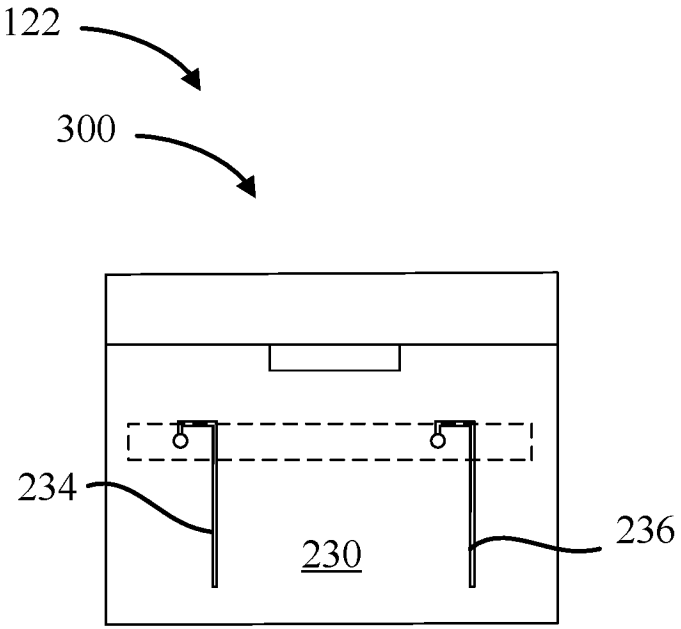
FIG. 6B illustrates a side view of an immobilizer tray, in accordance with various embodiments.
Figure 6A:
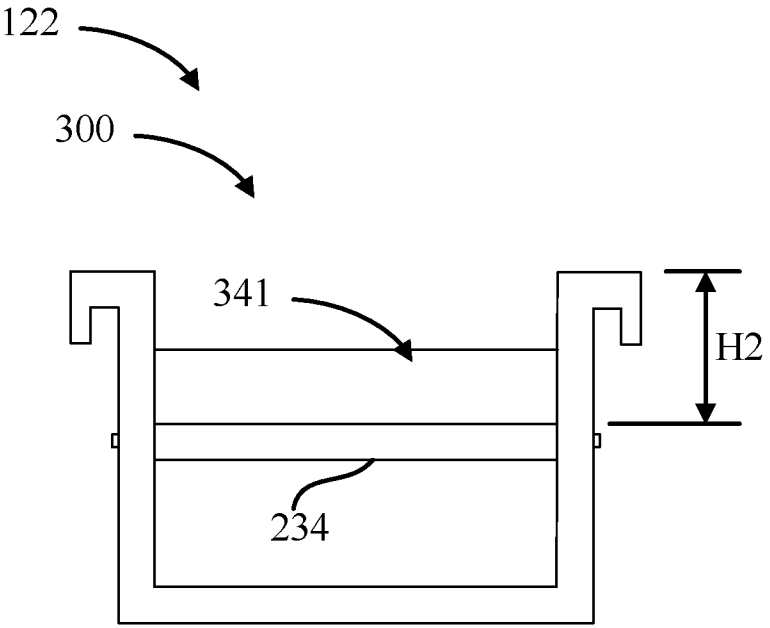
FIG. 6A illustrates a front view of an immobilizer tray, in accordance with various embodiments.

With combined reference to FIGS. 5A and 6A, in the first configuration 200, the moveable plate 240 is in a first position 241, and in the second configuration 300, the moveable plate 240 is in a second position 341. In this regard, the moveable plate 240 is configured to transition between the first position 241 in FIG. 5A and the second position 341, as described further herein. In the first position 241, a top end 222, 232 of the sidewalls 220, 230 and the moveable plate 240 define a first height H1 therebetween. Similarly, in the second configuration 300 of FIGS. 3A-B, the top end 222, 232 of the sidewalls 220, 230 and the moveable plate 240 define a second height H2 therebetween. In various embodiments, the second height H2 is approximately half of the first height H1. Although illustrated as being approximately half of the first height H1, the second height H2 is not limited in this regard. For example, the second height H2 can be between a quarter of the first height and three-quarters of the first height, in accordance with various embodiments. In various embodiments, the immobilizer tray 122 can be configured to transition between a multitude of configurations to change a height defined between the moveable plate 240 and the top end 222, 232 of the sidewalls 220, 230. In this regard, various payload heights can be accommodated by the immobilizer tray 122 and be within the scope of this disclosure.

Referring now to FIGS. 5A, 5B, and 5C, the first sidewall 220 extends from a first side 212 of the base plate 210 vertically (i.e., in the Y-direction) to a top end 222. Similarly, the second sidewall extends from a second side 214 of the base plate 210 vertically (i.e., in the Y-direction) to a top end 232. The base plate 210 extends laterally (i.e., in the X-direction) from the first sidewall 220 to the second sidewall 230, and longitudinally (i.e., in the Z-direction) from an aft side 216 to a forward side 218.

In various embodiments, the moveable plate 240 is configured to transition from first position 241 that defines the first configuration 200 from FIGS. 5A, 5B, and 5C to the second position 341 that defines the second configuration 300 from FIGS. 6A and 6B. In the first position 241, the moveable plate 240 is adjacent to the base plate 210. "Adjacent" to the base plate 210, as referred to herein, includes being in contact with the base plate 210, within 0.5 inches (1.27 cm) of the base plate 210, or within 0.25 inches (0.635 cm) of the base plate 210, or within 0.1 inches (0.254 cm) of the base plate 210. The present disclosure is not limited in this regard. In various embodiments, the moveable plate 240 is in contact with the base plate 210 in the first position 241 of the first configuration 200.

Referring now to FIGS. 5B and 5C, the sidewalls 220, 230 can each comprise a first slot (e.g., slot 224 of first sidewall 220 and slot 234 of second sidewall 230) spaced apart longitudinally (i.e., in the Z-direction) from a second slot (e.g., slot 226 of first sidewall 220 and slot 234 of second sidewall 230). In various embodiments, slot 224 of the first sidewall 220 is disposed laterally opposite (i.e., in the X-direction) from the slot 234 of the second sidewall 230. Similarly, the slot 226 of the first sidewall 220 is disposed laterally opposite from the slot 236 of the second sidewall 230. Stated another way, the slot 224 mirrors the slot 234 about a central plane (e.g., a Y-Z plane) through the base plate 210, and the slot 226 mirrors the slot 236 about the central plane, in accordance with various embodiments.

In various embodiments, the moveable plate 240 can be slidingly engaged with the slot 224, 234 and the slot 226, 236 of the sidewalls 220, 230. Stated another way, the moveable plate 240 is configured to transition from the first position 241 of the first configuration 200 as shown in FIGS. 5A-C to the second position 341 of the second configuration 300 to receive a different size payload (e.g., payload 201 in the first configuration 200 as shown in FIGS. 2A and 2B and payload 301 in the second configuration 300 as shown in FIGS. 3A and 3B), in accordance with various embodiments. In this regard, the moveable plate 240 can be configured to translate in a vertical direction (i.e., the Y-direction) and/or in a longitudinal direction (i.e., the Z-direction) based on a shape of the slots 224, 226, 234, 236 to accommodate a different size payload. Although illustrated as including slots 224, 226, 234, 236 to accommodate transitioning between the first configuration 200 of FIGS. 5A-C and the second configuration 300 of FIGS. 5A-B, the present disclosure is not limited in this regard. For example, the moveable plate 240 could be pivotably coupled to the third sidewall 250, pivotably coupled to one of (or both of) the first sidewall 220 and/or the second sidewall 230, or the like. Additionally, the moveable plate 240 could be separate from (or removably coupled to) the base plate 210 and the sidewalls 220, 230, 250 and be configured to be placed on a shoulder, slide into a track, or the like, and be within the scope of this disclosure. In this regard, any moveable plate, whether attached, detached, slidingly coupled, pivotably coupled, rotatably coupled, or the like that is capable of transitioning the immobilizer tray 122 from a first configuration 200 capable of receiving the payload 201 from FIGS. 2A-B to the second configuration 300 capable of receiving the payload 301 from FIGS. 3A-B, is within the scope of this disclosure.

In various embodiments, each slot (e.g., slots 224, 226 of first sidewall 220 and slots 234, 236 of second sidewall 230) includes a vertical portion (e.g., vertical portion 223, 227, 233, 237) extending from a bottom end to a top end and a longitudinal portion (e.g., longitudinal portion 225, 228, 235, 238) extending from the top end of the vertical portion to a longitudinal end spaced apart longitudinally from the top end. In various embodiments, each slot (e.g., slots 224, 226 of first sidewall 220 and slots 234, 236 of second sidewall 230) further comprises a notch (e.g., notch 221 of slot 224, notch 229 of slot 226, notch 231 of slot 234, and notch 239 of slot 236). In various embodiments, the notch can be a vertical notch for a corresponding element (e.g., a protrusion, a rod, a pin, or the like) of the moveable plate 240 to slide into and complete a transition from the first configuration 200 of FIGS. 5A-C to the second configuration 300 of FIGS. 6A-B. In this regard, the notches (e.g., notch 221 of slot 224, notch 229 of slot 226, notch 231 of slot 234, and notch 239 of slot 236) can provide a location for a corresponding element (e.g., a protrusion, a rod, a pin, or the like) of the moveable plate 240 to settle prior to disposing the payload 301 from FIGS. 3A and 3B therein. Although illustrated as including notches 221, 229, 231, 239, the present disclosure is not limited in this regard. For example, the notches can be eliminated, and a weight of the payload can keep the moveable plate 240 in position in the second configuration 300 without the notches, and still be within the scope of this disclosure.

In various embodiments, the moveable plate 240 is slidingly coupled to the first sidewall 220 and the second sidewall 230. In this regard, the moveable plate 240 further comprises a guide corresponding to each slot (e.g., slots 224, 226 of first sidewall 220 and slots 234, 236 of first sidewall 220). For example, the moveable plate 240 comprises a guide 242 for slot 224 of the first sidewall 220, a guide 243 for slot 226 of the first sidewall 220, a guide 244 for the slot 234 of the second sidewall 230, and a guide 245 for the slot 236 of the second sidewall 230. In various embodiments, each guide (e.g., guide 242, 243, 244, 245) can comprise a pin and a head. In this regard, the pin can extend through the respective slot (e.g., slots 224, 226 of first sidewall 220 and slots 234, 236 of first sidewall 220), and the head can ensure that the pin remains in the slot, and the moveable plate 240 remains moveably coupled to the sidewalls 220, 230. Although described herein as including a pin and head configuration for the guides 242, 243, 244, 245, the present disclosure is not limited in this regard. For example, the slot can define a rack and the guide can be a pinion, the slot can define a groove and the guide can include a wheel, or the like and still be within the scope of this disclosure.

Figure 7:
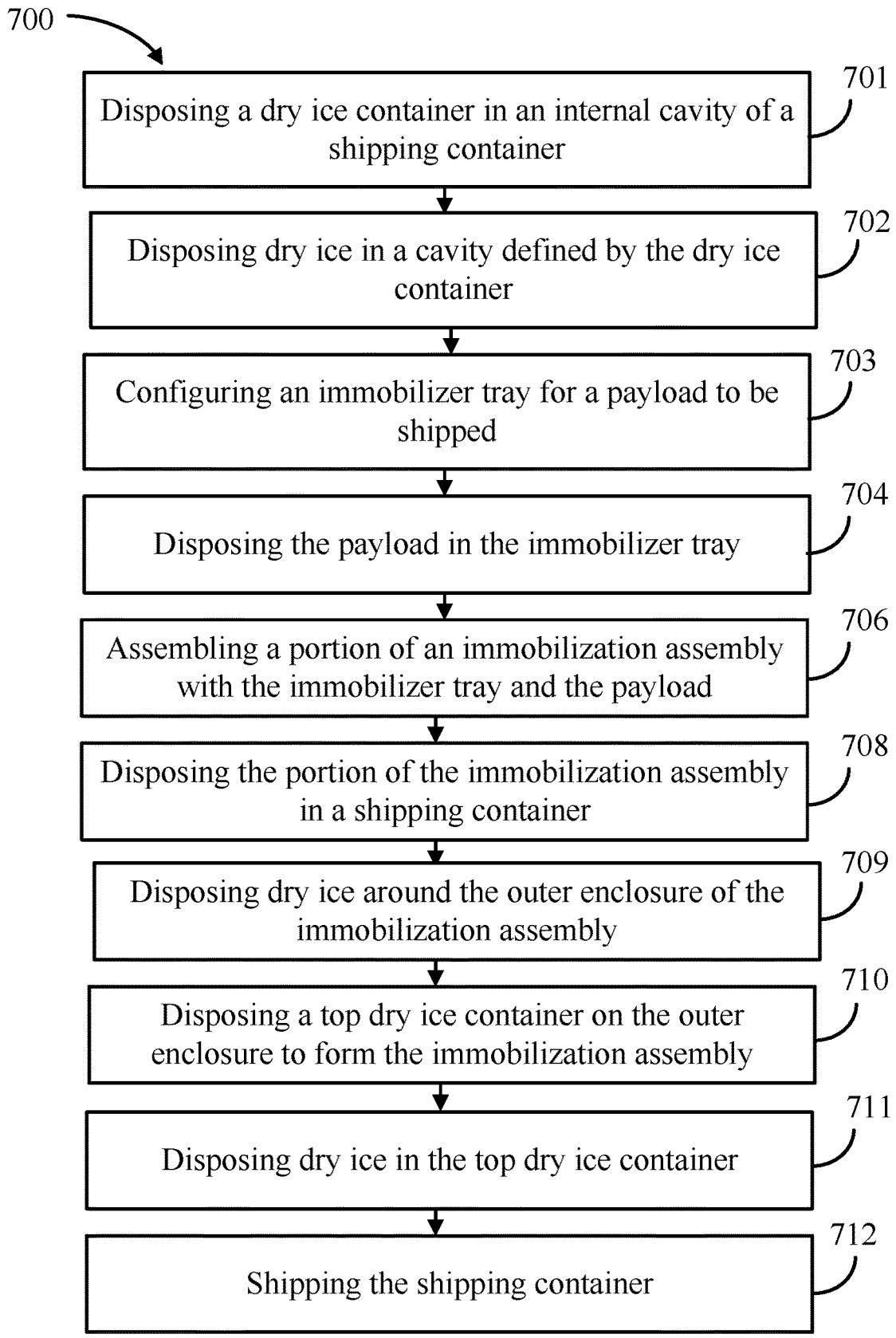
FIG. 7 illustrates a method of loading and shipping a shipping container, in accordance with various embodiments.

Referring now to FIG. 7, a method 700 of using a shipping container (e.g., shipping container 100 from FIG. 1) is illustrated, in accordance with various embodiments. With combined reference to FIGS. 1, 2A-B, 3A-B, 4A-C, 5A-C, 6A-B, and 7, the method 700 comprises disposing a base dry ice container (e.g., dry ice container 112) into an internal cavity 105 of a base 102 of a shipping container 100 (step 701). In various embodiments, the method 700 further comprises disposing dry ice in a cavity 113 defined by the dry ice container 112 (step 702). The dry ice disposed in the cavity 113 can be configured below the payload that is loaded in the shipping container 100 as described further herein.

The method 700 further comprises configuring an immobilizer tray 122 for a payload to be shipped (step 703). For example, the immobilizer tray 122 can be configured in the first configuration 200 of FIGS. 2A-B to receive a payload 201, in the second configuration 300 of FIGS. 3A-B, or the like. Although only described herein as being configurable between the two configurations, any number of configurations for receiving various sizes of payloads is within the scope of this disclosure. In various embodiments, step 703 can further comprise transitioning the immobilizer tray 122 from the first configuration 200 to the second configuration 300, or vice versa. In this regard if the immobilizer tray 122 is in the first configuration 200, and the payload that is being shipped is in accordance with the payload 301, the immobilizer tray 122 can be reconfigured from the first configuration 200 to the second configuration 300 to accommodate the payload 301, in accordance with various embodiments. Similarly, if the immobilizer tray 122 is in the second configuration 300, and the payload that is being shipped is in accordance with the payload 201, the immobilizer tray 122 can be reconfigured from the second configuration 300 to the first configuration 200 to accommodate the payload 201.

In various embodiments, configuring the immobilizer tray 122 in step 703 can further comprise translating the moveable plate 240 of the immobilizer tray 122 from a first position 241 to a second position 341 in response to transitioning from the first configuration 200 to the second configuration 300. Similarly, configuring the immobilizer tray 122 in step 703 can further comprise translating the moveable plate 240 of the immobilizer tray 122 from a second position 341 to a first position 241 in response to transitioning from the second configuration 300 to the first configuration 200.

In various embodiments, transitioning the moveable plate 240 from the first position 241 to the second position 341, or vice versa, further comprises sliding the moveable plate vertically relative to the sidewalls 220, 230 of the immobilizer tray 122 and placing the moveable plate in the desired position (e.g., the first position 241 or the second position 341).

In various embodiments, the method 700 further comprises disposing the payload (e.g., payload 201 in response to the immobilizer tray 122 being in the first configuration 200 after step 703 or payload 301 in response to the immobilizer tray 122 being in the second configuration 300 after step 703) in the immobilizer tray 122 (step 704). In this regard, the payload (e.g., payload 201 or payload 301) can be initially immobilized in a lateral direction (i.e., the X-direction) between sidewalls 220, 230 of the immobilizer tray 122.

In various embodiments, the method 700 further comprises assembling a portion of an immobilization assembly 120 with the immobilizer tray 122 and the payload (e.g., payload 201 or payload 301) (step 706). In various embodiments, the immobilizer tray 122, with the payload disposed therein, is placed in the outer enclosure 124 of the immobilization assembly 120. In various embodiments, the immobilizer tray 122 is placed in the outer enclosure 124 prior to placing the payload (e.g., payload 201 or payload 301) therein. The present disclosure is not limited in this regard. In various embodiments, once the outer enclosure 124 is assembled with the immobilizer tray 122 and the payload (e.g., payload 201 or payload 301) therein, the payload is immobilized in the lateral direction (X-direction) by the immobilizer tray 122 and in the Z-direction by the immobilizer tray 122 and the outer enclosure 124, or solely by the outer enclosure 124, as described previously herein.

In various embodiments, the method 700 further comprises disposing the portion (i.e., the outer enclosure 124 with the immobilizer tray 122 and the payload 201 or the payload 301 disposed therein) of the immobilization assembly 120 in a shipping container 100 (step 708). In various embodiments, the outer enclosure 124 is placed within the receptacle 118 defined by the barriers 117 and the handles 115 of the dry ice container 112. In this regard, the outer enclosure 124 can be immobilized relative to the dry ice container 112 in the lateral direction (i.e., the X-direction) and the longitudinal direction (i.e., the Z-direction).

In various embodiments, the method 700 further comprises surrounding a perimeter of the outer enclosure 124 of the immobilization assembly 120 with dry ice (step 709). In this regard, the payload (e.g., payload 201 or payload 301) can have ice disposed below the payload (e.g., in cavity 113 defined by the dry ice container 112) and around the payload (e.g., between internal walls defined by internal cavity 105 of the base 102 of the shipping container and the outer enclosure 124).

In various embodiments, the method 700 further comprises disposing a top dry ice container (e.g., dry ice container 114) on top of the outer enclosure 124 to form the immobilization assembly 120 (step 710). In this regard, the dry ice container 114 can be placed on the immobilizer tray 122 after the immobilizer tray 122, the outer enclosure 124, and the payload (e.g., payload 201 or payload 301) are placed in the internal cavity 105 of the shipping container 100 (e.g., in the cavity 113 defined by the dry ice container 112, or the like).

In various embodiments, the method 700 further comprises disposing dry ice in the dry ice container 114 (step 711). Although described herein as placing dry ice in the dry ice container 114 after the dry ice container 114 is disposed in the shipping container 100, the present disclosure is not limited in this regard. For example, dry ice can be placed in the dry ice container 114 prior to placing the dry ice container 114 on top of the outer enclosure 124 and still be within the scope of this disclosure.

In various embodiments, the immobilization assembly 120 can be formed in its entirety in response to placing a dry ice container 114 (with dry ice disposed therein) on top of the outer enclosure 124. In this regard, the dry ice container 114 and the moveable plate 240 of the immobilizer tray 122 can immobilize the payload (e.g., payload 201 or payload 301) in the vertical direction (i.e., the Y-direction) to completely immobilize the payload in the X-direction, the Y-direction, and the Z-direction during shipment of the payload.

In various embodiments, the dry ice is disposed in the dry ice container 114 after the immobilizer tray 122, the outer enclosure 124, and the payload (e.g., payload 201 or payload 301) are disposed within the shipping container 100. In this regard, the dry ice in the dry ice container 114 can be a final step prior to shipment to ensure the dry ice remains as cold as possible prior to shipment.

In various embodiments, the method 700 further comprises closing the shipping container 100 (e.g., closing the lid 104) to seal the payload (e.g., payload 201 or payload 301) therein, and shipping the shipping container 100 (step 712).

In various embodiments, the immobilization assembly 120 can be removed from the shipping container 100 prior to performing method 700. For example, the shipping container 100 can be received with a first payload (e.g., payload 201 or payload 301) disposed therein, and a next shipment may be of a second payload (e.g., payload 301 when the prior payload was 201, or payload 201 when the prior payload was 301). In this regard, after removing the first payload (e.g., payload 201 or payload 301) from the immobilizer tray 122, the immobilizer tray 122 can be reconfigured to accommodate the second payload in accordance with step 703 described previously herein.

In various embodiments, the method 700 can facilitate transportation of various size payloads, maintain immobilization of the various size payloads in an efficient manner. For example, the transition between different configuration (e.g., first configuration 200 and second configuration 300) can be facilitated in seconds to accommodate a smaller payload, while maintaining immobilization of the different size payload in a similar manner throughout transport of the different size payload.

Benefits, other advantages, and solutions to problems have been described herein regarding specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods, and apparatus are provided herein. In the detailed description herein, references to "one embodiment," "an embodiment," "various embodiments," etc., indicate that the embodiment described may include a particular feature, structure, or characteristic, but every embodiment may not necessarily include the feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112 (f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

Finally, any of the above-described concepts can be used alone or in combination with any or all the other above-described concepts. Although various embodiments have been disclosed and described, one of ordinary skill in this art would recognize that certain modifications would come within the scope of this disclosure. Accordingly, the description is not intended to be exhaustive or to limit the principles described or illustrated herein to any precise form. Many modifications and variations are possible considering the above teaching.

What is claimed is:

1. An adaptable immobilizer tray, comprising:
a base plate;
a first sidewall extending vertically from a first side of the base plate;
a second sidewall extending vertically from a second side of the base plate; and
a moveable plate configured to transition from a first position adjacent to the base plate to a second position vertically spaced apart from the base plate,
wherein:
the first sidewall and the second sidewall each comprise a first slot spaced apart longitudinally from a second slot,
the first slot and the second slot of the first sidewall and the second sidewall each comprise a vertical portion extending from a bottom end to a top end.

2. The adaptable immobilizer tray of claim 1, wherein:
the moveable plate is slidingly engaged with the first slot and the second slot of the first sidewall and the second sidewall,
the first slot of the first sidewall is disposed laterally opposite the first slot of the second sidewall, and
the second slot of the first sidewall is disposed laterally opposite the second slot of the second sidewall.

3. The adaptable immobilizer tray of claim 2, wherein the first slot and the second slot of the first sidewall and the second sidewall each comprise:
a longitudinal portion extending from the top end to a longitudinal end spaced apart longitudinally from the top end.

4. The adaptable immobilizer tray of claim 3, further comprising a notch disposed in the longitudinal end of the longitudinal portion.

5. The adaptable immobilizer tray of claim 1, further comprising a first configuration corresponding to the moveable plate being in the first position and a second configuration corresponding to the moveable plate being in the second position, the first configuration configured to receive a first payload, the second configuration configured to receive a second payload, the first payload having a larger volume than the second payload.

6. The adaptable immobilizer tray of claim 5, wherein the first payload has a first volume that is between up to two times greater than a second volume of the second payload.

7. The adaptable immobilizer tray of claim 1, wherein the first sidewall and the second sidewall each comprise a plurality of apertures disposed therethrough.

8. The adaptable immobilizer tray of claim 1, wherein the moveable plate is slidingly coupled to the first sidewall and the second sidewall.

9. A shipping container, comprising:
an enclosure; and
an adaptable immobilizer tray configured to be disposed within a cavity of the enclosure, the adaptable immobilizer tray being reconfigurable between a first configuration and a second configuration, the first configuration configured to secure a first payload, the second configuration configured to secure a second payload, the first payload being a different volume relative to the second payload, the adaptable immobilizer tray comprising:
a base plate:
a first sidewall extending vertically from a first side of the base plate;
a second sidewall extending vertically from a second side of the base plate; and
wherein:
the first sidewall and the second sidewall each comprise a first slot spaced apart longitudinally from a second slot,
the first slot and the second slot of the first sidewall and the second sidewall each comprise a vertical portion extending from a bottom end to a top end.

10. The shipping container of claim 9, wherein the enclosure includes a lid and a base, the lid configured to transition between a closed position and an open position to provide access to the cavity.

11. The shipping container of claim 9, wherein:
the adaptable immobilizer tray includes a moveable plate configured to transition a height of a payload area from a first height to a second height, and
the second height is less than the first height.

12. The shipping container of claim 11, wherein the first height is between up to two times greater than the second height.

13. The shipping container of claim 9, wherein:
the adaptable immobilizer tray includes a moveable plate, and
the moveable plate is moveably coupled to the first sidewall and the second sidewall.

14. The shipping container of claim 13, wherein:
the moveable plate comprises a first guide and a second guide,
the first guide is configured to engage the first slot of the first sidewall, and
the second guide is configured to engage the first slot of the second sidewall.

15. The shipping container of claim 14, wherein the first slot of the first sidewall is disposed laterally opposite the first slot of the second sidewall.

16. The shipping container of claim 14, wherein:
the second slot of one of the first sidewall and the second sidewall is disposed aft of the first slot of said one of the first sidewall and the second sidewall,
the moveable plate further comprises a third guide and a fourth guide,
the third guide is configured to engage the second slot of the first sidewall, and
the fourth guide is configured to engage the second slot of the second sidewall.

17. A method of using a shipping container, comprising:
transitioning an adaptable immobilizer tray from a first configuration to a second configuration, the first configuration configured to receive a first payload;
disposing a second payload in the adaptable immobilizer tray, the second payload having a smaller volume relative to the first payload;
placing the adaptable immobilizer tray and the second payload in a cavity of the shipping container;
disposing a dry ice container on the adaptable immobilizer tray, the dry ice container including dry ice disposed therein, the second payload restrained vertically between the dry ice container and the adaptable immobilizer tray; and
closing the shipping container,
wherein the adaptable immobilizer tray comprises:
a base plate;
a first sidewall extending vertically from a first side of the base plate;
a second sidewall extending vertically from a second side of the base plate; and wherein:

the first sidewall and the second sidewall each comprise a first slot spaced apart longitudinally from a second slot, and the first slot and the second slot of the first sidewall and the second sidewall each comprise a vertical portion extending from a bottom end to a top end.

18. The method of claim 17, wherein:

the transitioning the adaptable immobilizer tray from the first configuration to the second configuration further comprises translating a moveable plate of the adaptable immobilizer tray from a first position to a second position, and the second payload is retrained vertically between the dry ice container and the moveable plate in response to the disposing the dry ice container on the adaptable immobilizer tray.

19. The method of claim 18, wherein the transitioning the moveable plate from the first position to the second position further comprises sliding the moveable plate vertically relative to the first sidewall and the second sidewall of the adaptable immobilizer tray and placing the moveable plate in the second position.

20. The method of claim 18, wherein:

the moveable plate defines a first height for a payload area relative to a top edge of the adaptable immobilizer tray, the moveable plate defines a second height for the payload area relative to the top edge of the adaptable immobilizer tray, and the first height is greater than the second height.

21. An adaptable immobilizer tray, comprising:

a base plate;

a first sidewall extending vertically from a first side of the base plate;

a second sidewall extending vertically from a second side of the base plate; and a moveable plate configured to transition from a first position adjacent to the base plate to a second position vertically spaced apart from the base plate, wherein:

the first sidewall and the second sidewall each comprise a first slot spaced apart longitudinally from a second slot, the moveable plate is slidingly engaged with the first slot and the second slot of the first sidewall and the second sidewall, the first slot of the first sidewall is disposed laterally opposite the first slot of the second sidewall, the second slot of the first sidewall is disposed laterally opposite the second slot of the second sidewall, and the first slot and the second slot of the first sidewall and the second sidewall each comprise:

a vertical portion extending from a bottom end to a top end, and a longitudinal portion extending from the top end to a longitudinal end spaced apart longitudinally from the top end.

* * * * *